US008500299B2

(12) United States Patent
Speidel et al.

(10) Patent No.: US 8,500,299 B2
(45) Date of Patent: Aug. 6, 2013

(54) NARROW BEAM LED SPOTLIGHT

(75) Inventors: John Speidel, Highland Falls, NY (US); Vincent Gennarelli, Washingtonville, NY (US); Frank Reidmiller, Highland Lakes, NJ (US); Peter Eagleton, Yorktown Heights, NY (US); Jose Cadena, Mt. Kisco, NY (US); Scott Wisniewski, Highland Falls, NY (US); Andrew P. Arena, Shrewsbury, MA (US)

(73) Assignee: Lighting Services Inc., Stony Point, NY (US)

( * ) Notice: Subject to any disclaimer, the term of this patent is extended or adjusted under 35 U.S.C. 154(b) by 195 days.

(21) Appl. No.: 13/219,194

(22) Filed: Aug. 26, 2011

(65) Prior Publication Data

US 2013/0051006 A1 Feb. 28, 2013

(51) Int. Cl.
*F21V 1/00* (2006.01)

(52) U.S. Cl.
USPC ..... 362/235; 362/296.05; 362/303

(58) Field of Classification Search
USPC ..... 362/296.05, 303, 804, 311.02, 249.02
See application file for complete search history.

(56) References Cited

U.S. PATENT DOCUMENTS

| | | | | |
|---|---|---|---|---|
| 6,464,373 | B1 | 10/2002 | Petrick | |
| 7,479,622 | B2 * | 1/2009 | May et al. | 250/205 |
| 7,794,112 | B2 * | 9/2010 | Higashi et al. | 362/248 |
| 7,980,728 | B2 * | 7/2011 | Ramer et al. | 362/249.02 |
| 7,988,336 | B1 | 8/2011 | Harbers et al. | |
| 8,220,970 | B1 * | 7/2012 | Khazi et al. | 362/294 |
| 2005/0030740 | A1 * | 2/2005 | Kumthampinij et al. | 362/157 |
| 2006/0039160 | A1 | 2/2006 | Cassarly et al. | |
| 2007/0133209 | A1 * | 6/2007 | Wang et al. | 362/294 |
| 2008/0074885 | A1 | 3/2008 | Brands et al. | |
| 2009/0231856 | A1 | 9/2009 | Householder et al. | |
| 2010/0309665 | A1 | 12/2010 | Young et al. | |
| 2012/0069562 | A1 * | 3/2012 | Singer et al. | 362/231 |
| 2012/0236563 | A1 * | 9/2012 | Breidenassel et al. | 362/249.02 |

* cited by examiner

*Primary Examiner* — Evan Dzierzynski
(74) *Attorney, Agent, or Firm* — St. Onge Steward Johnston & Reens LLC

(57) ABSTRACT

A narrow angle LED illuminated spotlight in which the light-emitting output of an LED light source is coupled with an optic element, in the form of a focusing reflector or focusing lens, and a masking element is interposed between the light source and the optic element to partially mask off the output area of the light source and significantly reduce the area of the emitted light reaching the optic element. This enables the light passed by the masking element to be concentrated into a, narrow beam (i.e., 18° or less) using an optic element of much smaller size than otherwise, thus making the use of an LED light source module a practical source of light for narrow beam spotlights.

12 Claims, 5 Drawing Sheets

NARROW BEAM LED SPOTLIGHT

FIELD OF THE INVENTION

This invention relates to commercial and stage lighting fixtures and more particularly to improvements in such fixtures of the type incorporating LED elements as a light source.

BACKGROUND OF THE INVENTION

Light emitting diodes (LEDs) are increasingly being utilized as a light source in various lighting fixtures because of their inherently high efficiency in converting electrical power to light. Although LED elements are relatively expensive, compared to incandescent and other forms of light sources, the initial cost is recovered over time through energy conversion efficiencies. A typical LED light source suitable for commercial and theatrical lighting can be comprised of a plurality of individual LED elements arranged in an enclosed housing to discharge light through an output lens or window of a predetermined size and shape. A representative such light source is shown in, for example, the Harbers et al U.S. Pat. No. 7,988,336, assigned to Xicato, Inc., the content of which is incorporated herein by reference.

A frequent requirement of commercial and theatrical lighting is to be able to confine light output of a luminaire or light fixture to a relatively narrow beam, for example as narrow as 8 degrees, so that a particular object can be highlighted in relation to its immediate surroundings. With available commercial LED illumination modules, such as the shown in the before mentioned Harbers et al patent, the light output lens or window covers a plurality of LED elements and accordingly is of relatively large diameter. The emitted light is somewhat diffused in that it originates from a plurality of sources and confinement of the light into a tight beam requires reflectors, typically of a compound parabolic configuration, to be undesirably long in an axial direction. Conventional reflectors thus tend to a compromise, combining a somewhat shorter reflector with a wider-than-desired beam concentration.

SUMMARY OF THE INVENTION

The invention is directed to a narrow beam spot light, incorporating an LED illumination module as the light source, in combination with a beam concentrator in the form of a reflector or lens. For this purposes of this invention and this application, a narrow beam is considered to be 18 degrees or less. Pursuant to the invention, a masking element is interposed between the illumination module and the concentrator. The masking element has an aperture which is of substantially smaller area than the illumination output area of the LED module. The arrangement is such that only the light passing through the aperture of the masking element reaches the concentrator. This allows the light to be concentrated into a narrow beam with a concentrator of much smaller size than is normally required, and renders the use of an LED illumination module as a practical source of light for a narrow beam luminaire of reasonable size. Heretofore, the use of LED modules has required the use of concentrators of such large size as to be unsuitable for many practical applications.

For a more complete understanding of the above and other features and advantages of the invention, reference should be made to the following detailed description of a preferred embodiment of the invention and also to the accompanying drawings illustrating the same.

DETAILED DESCRIPTION OF THE INVENTION

Figure 1:
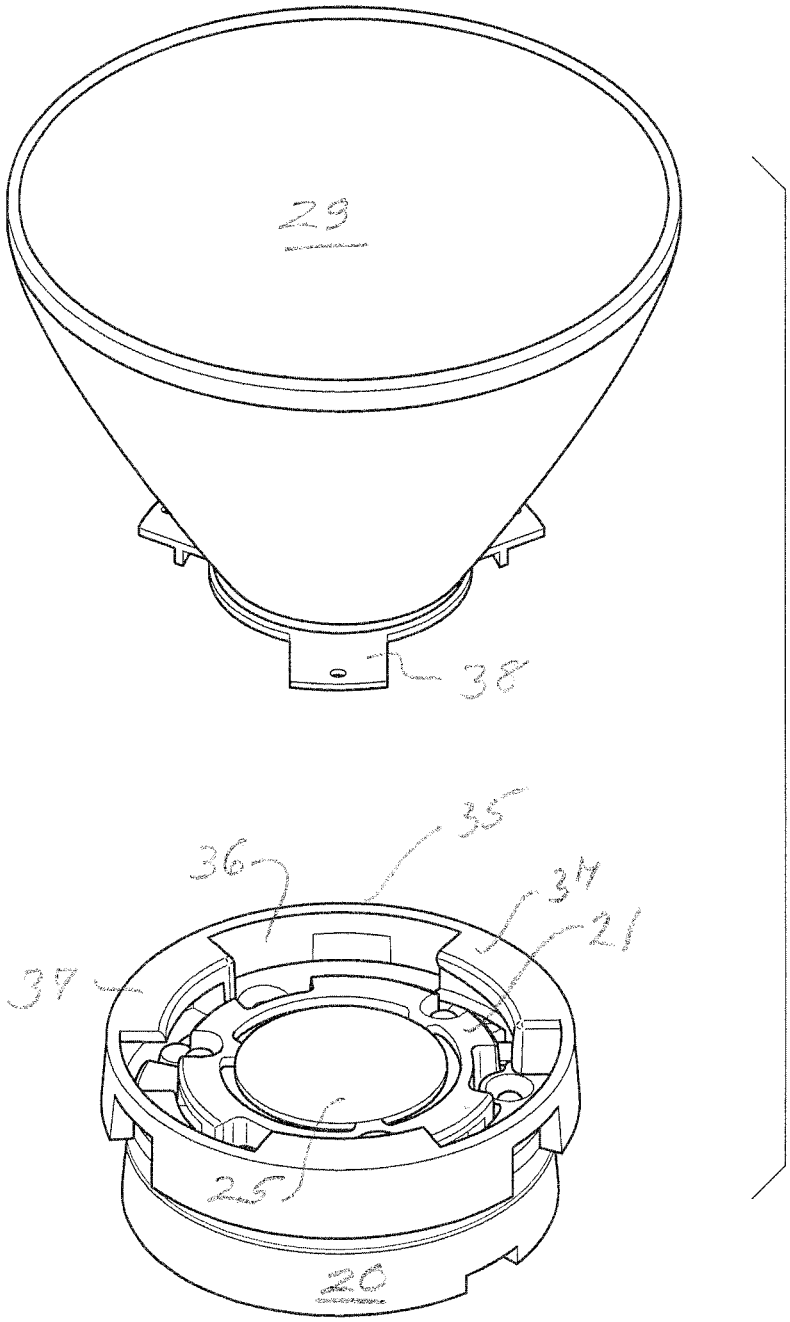
FIG. 1 is an exploded view of a narrow beam luminaire according to the invention, illustrating an LED illumination module and a reflector associated therewith.
Figure 2:
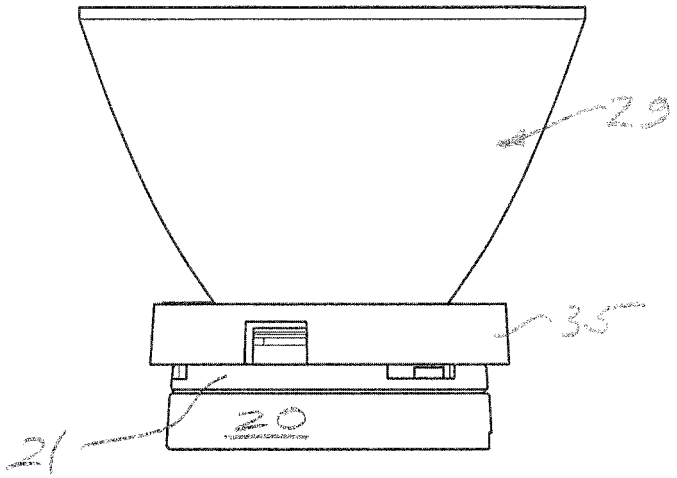
FIG. 2 is a side elevational view of the luminaire of the invention.
Figure 3:
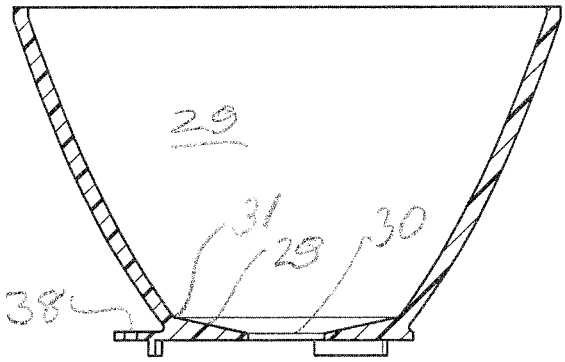
FIG. 3 is a longitudinal cross sectional view of a narrow beam reflector as shown in FIGS. 1 and 2, in which a masking element according to the invention is integrally incorporated.
Figure 4:
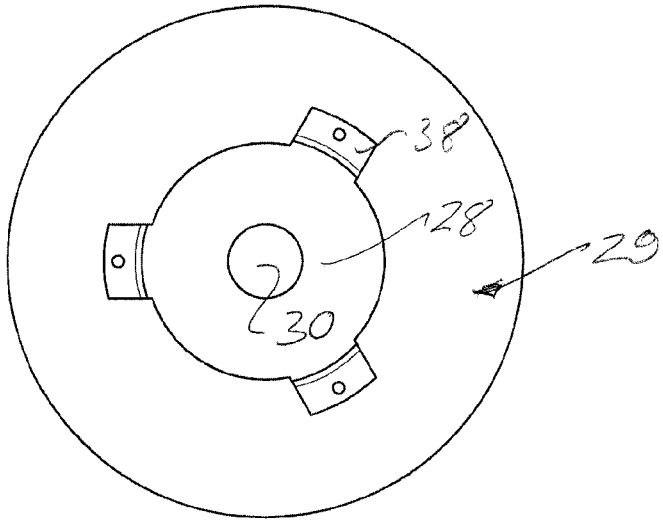
FIG. 4 is a bottom plan view of the reflector of FIG. 3.
Figure 5:
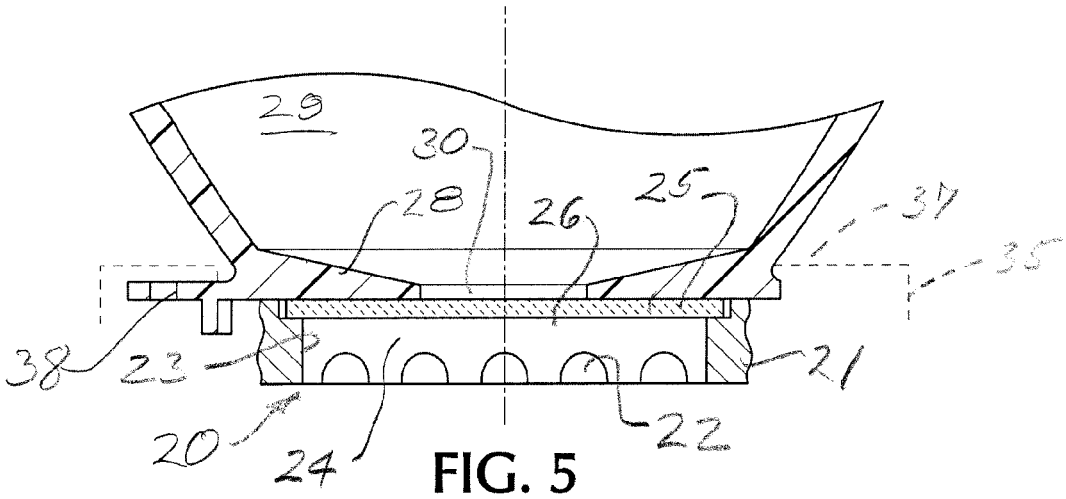
FIG. 5 is an enlarged, fragmentary cross sectional view illustrating the assembled association of the LED illumination module of FIG. 1 with the reflector of FIG. 3.

Referring now to the drawings, and initially to the embodiment shown in FIGS. 1-5 thereof, the reference numeral 20 designates generally an LED illumination module, preferably but not necessarily of the type marketed by Xicato, Inc of San Jose, Calif., under its product designation XSM 80 LED Module. Such a module is illustrated in the before mentioned U.S. Pat. No. 7,988,336. The module 20 includes a base 21 housing an array of a plurality of LED elements 22 (FIG. 5). Preferably and in the illustration of FIGS. 1, 2 and 5, the base 21 is of circular form with circular internal walls 23 forming a confined circular area 24 for the LED elements, which are spaced somewhat uniformly over the circular area 24. A window or lens 25 is secured to the base 21 over the opening at the top of the confined circular area 24, as shown in FIGS. 1 and 5. The circular internal walls 23 of the base define the illumination output aperture 26 of the module 20. Light emitted by the several LED elements 22 is directed upwardly out of the aperture 26, through the lens 25, which can be formed or treated to color and/or diffuse the light passing through it.

Commercially available LED illumination modules, such as the illustrated Xicato module, because they utilize a number of LED elements to produce the desired light output, tend to have illumination output apertures of considerable size. In the case of the Xicato XSM 80 module shown as an example, the illumination output aperture is approximately 22 mm in diameter.

Figure 6:
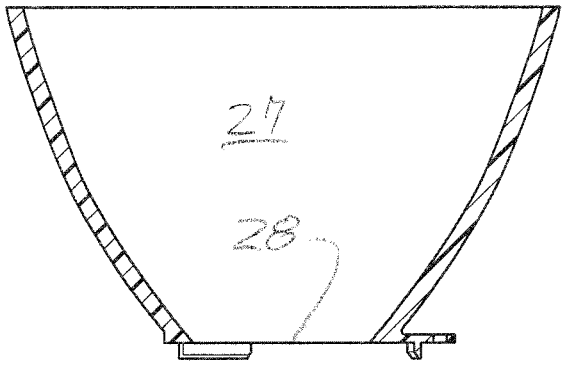
FIG. 6 PRIOR ART
FIG. 6 is a longitudinal cross sectional view of a reflector of prior art design that typically would be associated with an LED illumination module of the type shown in FIG. 1.

Many applications of commercial and theatrical lighting require a rather concentrated beam of light in order to highlight an object or person in relation to the immediate surroundings. For example, an 8° beam concentration is a common requirement. This has created a problem when using commercially available LED modules, however, in that a conventional, prior art concentrating reflector 26, shown in FIG. 6, formed with a base opening 27, of a diameter corresponding to that of the illumination output aperture of the LED module, must be excessively large in order to achieve the desired level of beam concentration. By way of example, a prior art reflector of the type shown, with a conventional 22 mm opening at its base to correspond with the 22 mm illumination output of the LED module, requires a reflector of 86 mm length (measured axially) and 134 mm in diameter at the outer end, in order to concentrate the beam to 12°. An even larger size would be required to achieve an 8° concentration. There are very few circumstances where a reflector of such a large size would be accepted in a commercial luminaire. As a result, an unsatisfactory compromise has been accepted heretofore, wherein the reflector has been provided in an acceptable physical size (e.g., 70 mm outer end diameter and 42 mm length), and the end user has accepted a maximum beam concentration of only about 20°.

Utilizing the principles of the invention, however, a reflector of acceptable physical dimensions (e.g., a body of revolution of about 42 mm in length and about 70 mm in outer end diameter), can be utilized in combination with commercially available LED modules to achieve a desired beam concentration of 8°. This is accomplished in a surprising way, by interposing an opaque masking element 28 between the illumination output 26 and the concentrating reflector 29. In the illustrated embodiment of the invention, the masking element 28 is molded integrally with the side walls of the reflector 29. Theoretically, however, the masking element and reflector could be formed as a separate element.

According to the invention, the masking element 28 is of a size to cover the entire illumination output 26 of the LED module 20, and is provided with an aperture 30, preferably aligned with the axis of the reflector, that is significantly smaller in diameter than the illumination output 26. In one preferred and exemplary embodiment, a masking element aperture of 10 mm is used in a luminaire driven by an LED module 20 with a 22 mm illumination output 26. The area of such an aperture 30 is less than 23% of the total area of the illumination output.

When a masking element or component 28 with a restrictive aperture 30 is utilized, a reflector 29 of conventional configuration and acceptable physical dimensions can effectively concentrate the emitted LED light into a narrow beam of, for example, 8°. The concentrator itself may be of conventional configuration, for example a compound parabolic internal contour.

In the specifically illustrated example, shown in FIGS. 1-5, the diameter of the reflector at its base 31 can be considerably greater than that of the aperture 30. By way of example and not of limitation, the diameter at the base may be about 22 mm, generally consistent with the base diameter of the conventional reflector shown in FIG. 6 and with the illumination output 26 of the LED module. With such a configuration, the opaque portions of the integral masking element 28 extend radially inward from the base 31 to the aperture 30. The reflector base may also be of larger or smaller size, as long as the masking element 28 serves to mask off the illumination output of the LED module and confine its actual output to the aperture 30 of a predetermined smaller diameter than that of the illumination output 26.

The illustrated form of LED module 26 incorporates a mounting collar 35 having three radially spaced slots 36 and associated flanges 37. The reflector 29 is accordingly provided with three angularly spaced, radially projecting mounting members 38, which allow the reflector to be easily coupled with the LED module by way of a twist-lock action. When the masking element 28 is integral with the body of the reflector, as illustrated, a single twist-lock action mounts both the reflector and its associated masking element. The geometry of the components is such that the twist-lock mounting of the reflector positions and maintains the masking element 28 and its aperture 30 in close-coupled relation with the output lens 25 of the LED module, such that light discharged from the LED module is substantially exclusively through the restricted aperture 30.

The invention is in no way restricted to the particular dimensional relationships heretofore described. The underlying principle is that of restricting the output of light generated by an LED module to an area less than the intended illumination output area, and in conjunction therewith using a concentrator of reduced physical dimensions to achieve beam concentrations otherwise obtainable only from the use of concentrators of excessively large and unsuitable sizes. In the example given above, the use of a masking element with a 10 mm aperture, in connection with a 22 mm LED illumination output, enabled an 8° beam to be achieved with a reflector of 42 mm in length and 70 mm in diameter, whereas without masking the output of the LED module, a reflector 86 mm long and 134 mm wide was required to concentrate the beam in a wider 12° angle. Within the teachings of the invention, greater and lesser amounts of masking can be employed with a given LED illumination output, depending upon the desired level of concentration and the physical limitations imposed by other factors on the length and diameter of the reflector. A person skilled in the art can readily vary the extent of masking required or desired to achieve a given degree of beam concentration using a reflector of the desired size. The principles of the invention are useful to advantage to achieve beam concentrations over a range of 6° to 18°.

Figure 7:
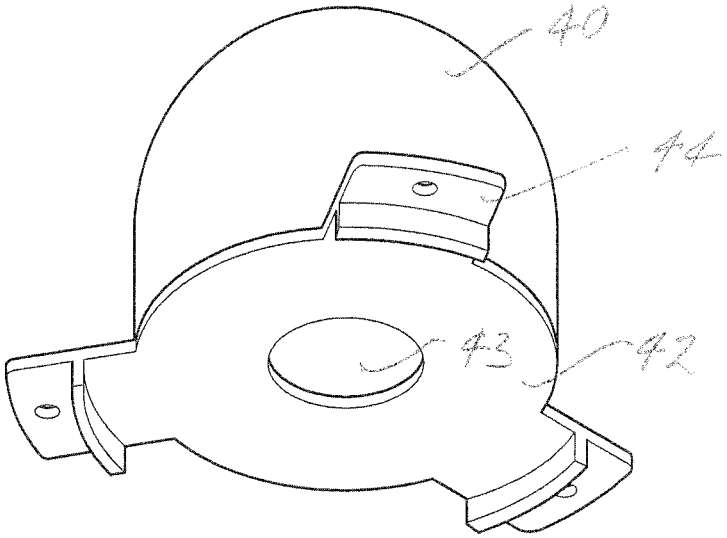
FIG. 7 is an isometric view, from below, of a beam-concentrating lens adapted for mounting on an LED illumination module as shown in FIG. 1 and incorporating a masking element formed with a center aperture for limiting the area of the illumination module that can pass light to the lens.
Figure 8:
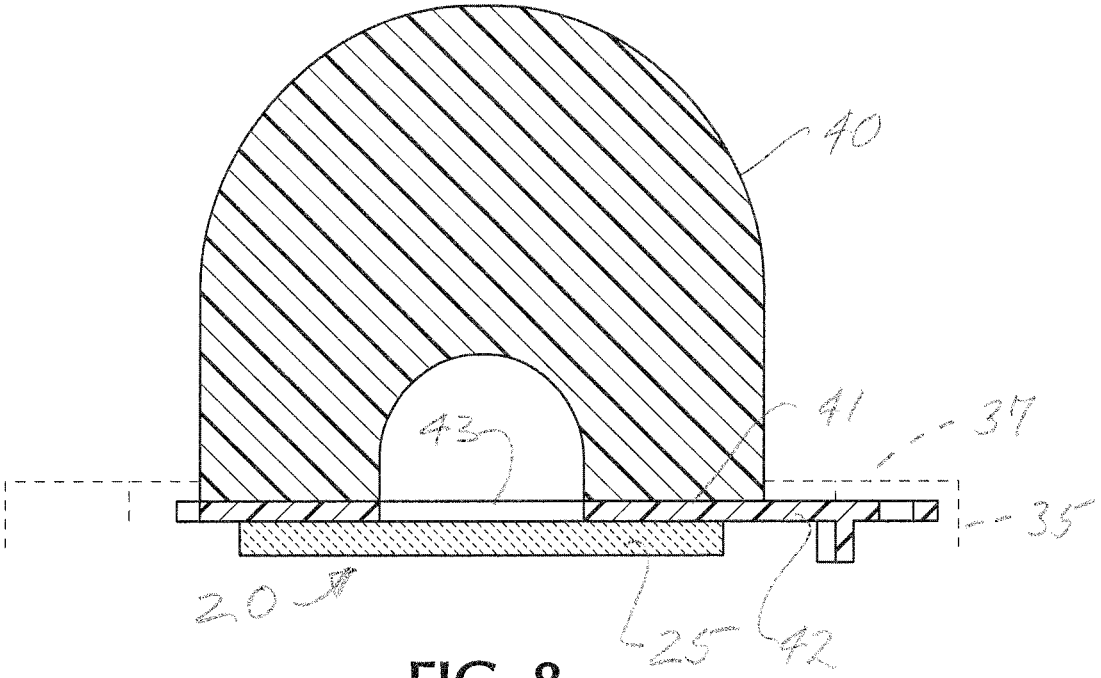
FIG. 8 is a longitudinal cross sectional view of the lens of FIG. 7 illustrating the association of the masking element and its aperture with the illumination output of the LED module.

The invention is also not limited to the use of reflectors as beam concentrators but also is applicable to luminaires incorporating concentrating lenses. Such an arrangement is illustrated in FIGS. 7 and 8 in which an optical lens 40 is joined at its base 41 with a masking element 42 provided with a central aperture 43. The masking element 42 is formed with integral, radially extending mounting members 44 positioned for engagement with the mounting collar 35 of the LED module 20. When the masking element 42 is secured to the mounting collar, the bottom surface of the masking element is seated tightly against the upper surface of the lens 25 of the LED module, in the same manner as the masking element 28 of the embodiment of FIGS. 1-5. In the illustrative but non-limiting example of FIGS. 7-8, the aperture 43 may have a diameter of 10 mm, for use with an LED module 20 having an illumination output of 22 mm. Larger or smaller apertures 43 may be utilized, depending on the objectives of the designer. The aperture 43, by reducing the area of light that can be emitted by the LED module 20, enables the lens 40 to concentrate the light to a narrower beam than otherwise. In the illustration of FIGS. 7 and 8, a lens of about 27 mm in diameter, formed of clear acrylic, can be employed to achieve a beam concentration of 8°.

Although the form of the invention specifically disclosed herein utilizes an LED module having a circular illumination output, it is noted that some commercially available LED modules have differently shaped illumination outputs, such as square and rectangular. The underlying principles of the invention are also applicable to such differently shaped illumination outputs.

It will thus be understood that the specific embodiments of the invention herein illustrated and described are intended to be representative only and that many variations may be made therein within the broad teachings of the invention and the disclosure thereof. Accordingly, reference should be made to the following claims in determining the full scope of the invention.

What is claimed is:

1. A narrow angle LED illuminated spotlight, which comprises an LED light source having an illumination output of predetermined area, an optic member associated with said light source to receive light emitted from the light source and to reflect or refract said emitted light, said optic member having a base with a base area of predetermined size, a masking element interposed between said light source and the base of said optic member, said masking element being of a size and shape to effectively cover the illumination output of said light source and said masking element having an aperture therein of an area substantially less area than the base area of said optic member and less than half of the predetermined area of the illumination output of said LED light source, said optic member being associated with said aperture and positioned to receive light passing therethrough from said illumination output and to concentrate said light into a narrow beam.

2. A narrow angle LED illuminated spotlight according to claim 1, wherein said LED light source comprises a plurality of individual LED elements positioned to emit a diffused light through said illumination output.

3. A narrow angle LED illuminated spotlight, which comprises an LED light source having an illumination output of predetermined area, an optic member associated with said light source to receive light emitted from the light source and to reflect or refract said emitted light, a masking element interposed between said light source and said optic member, said masking element effectively covering said light source and having an aperture therein of an area substantially less than the predetermined area of said LED light source, said optic member being associated with said aperture and positioned to receive light passing therethrough from said illumination output and to concentrate said light into a narrow beam, said LED light source comprising an LED illumination module in which said illumination output is of a circular shape and of predetermined diameter, said masking element having an overall diameter at least as great as said illumination output and having a central aperture of a diameter substantially less than the diameter of said illumination output, and said optic member having an axis and being axially aligned with said central aperture.

4. A narrow angle LED illuminated spotlight according to claim 3, wherein said optic member is a reflector in the form of a body of revolution with side walls angled outward at a predetermined angle adjacent to said central aperture and at progressively smaller angles at axially greater distances from said central aperture.

5. A narrow angle LED illuminated spotlight according to claim 4, wherein said masking element is formed integrally with inner ends of side walls of said reflector.

6. A narrow angle LED illuminated spotlight according to claim 5, wherein said inner ends of said side walls have an inner diameter greater than the diameter of said central aperture.

7. A narrow angle LED illuminated spotlight, which comprises an LED light source having an illumination output of predetermined area, an optic member associated with said light source to receive light emitted from the light source and to reflect or refract said emitted light, a masking element interposed between said light source and said optic member, said masking element effectively covering said light source and having an aperture therein of an area substantially less than the predetermined area of said LED light source, said optic member being associated with said aperture and positioned to receive light passing therethrough from said illumination output and to concentrate said light into a narrow beam, said optic member having a base diameter which at least as large as a diameter of said illumination output.

8. A narrow angle LED illuminated spotlight, which comprises an LED light source having an illumination output of predetermined area, an optic member associated with said light source to receive light emitted from the light source and to reflect or refract said emitted light, a masking element interposed between said light source and said optic member, said masking element effectively covering said light source and having an aperture therein of an area substantially less than the predetermined area of said LED light source, said optic member being associated with said aperture and positioned to receive light passing therethrough from said illumination output and to concentrate said light into a narrow beam, said optic member being a reflector, and said masking element being formed integrally with said reflector.

9. An LED illumination device, which comprises an LED light source formed of a plurality of LED elements arranged to emit light through an illumination output of predetermined size and shape and area, an optic element closely coupled with said illumination output and shaped to focus light emitted through said illumination output, and a masking element interposed between said optic element and said output and having an aperture of less area than the area of said illumination output to reduce the area of the illumination output through which light can be emitted to said optic element, said illumination output comprising a lens of predetermined area positioned between said LED elements and said masking element, the area of said masking element aperture being substantially less than the area of said lens, said lens and said aperture being of circular form and aligned on a common axis, and said aperture having a diameter of less than half the diameter of said lens.

10. An LED illumination device, which comprises an LED light source formed of a plurality of LED elements arranged to emit light through an illumination output of predetermined size and shape and area, an optic element closely coupled with said illumination output and shaped to focus light emitted through said illumination output, and a masking element interposed between said optic element and said output and having an aperture of less area than the area of said illumination output to reduce the area of the illumination output through which light can be emitted to said optic element, said optic being a reflector in the form of a body of revolution with side walls disposed at a decreasing angle in relation to said axis with increasing distance from said lens, and said reflector having has a base diameter greater than said aperture.

11. An LED illumination device, which comprises an LED light source formed of a plurality of LED elements arranged to emit light through an illumination output of predetermined size and shape and area, an optic element closely coupled with said illumination output and shaped to focus light emitted through said illumination output, a masking element interposed between said optic element and said output and having an aperture of less area than the area of said illumination output to reduce the area of the illumination output through which light can be emitted to said optic element, said illumination device being a narrow beam spotlight, and said masking element being axially aligned with said optic and having an area at least as great as the area of said illumination output and an aperture of an area less than one half the area of said illumination output.

12. An LED illumination device according to claim 11, wherein said optic is a concentrating lens for receiving light emitted through said aperture and concentrating said light into a narrow beam.

* * * * *